United States Patent [19]

Dupeuble

[11] Patent Number: 5,002,435

[45] Date of Patent: Mar. 26, 1991

[54] DEVICE FOR MAKING CAST-IN-SITU PILES USING A CONTINUOUS HOLLOW AUGER

[75] Inventor: Paul Dupeuble, Noisy-le-Roi, France

[73] Assignee: Sondages Injections Forages "S.I.F." Entreprise Bachy, Levallois-Perret, France

[21] Appl. No.: 476,563

[22] Filed: Feb. 7, 1990

[30] Foreign Application Priority Data

Feb. 9, 1989 [FR] France ..... 89 01676

[51] Int. Cl.[5] ..... E02D 5/34

[52] U.S. Cl. ..... 405/241; 405/233; 405/240

[58] Field of Search ..... 405/232, 233, 240, 241, 405/242, 243; 175/321, 323

[56] References Cited

U.S. PATENT DOCUMENTS

| | | | |
|---|---|---|---|
| 2,838,283 | 6/1958 | Simmonds et al. | 175/321 X |
| 2,920,455 | 1/1960 | Ryser et al. | 405/241 |
| 4,433,943 | 2/1984 | Pao Chen | 405/241 |
| 4,821,818 | 4/1989 | Mefferd | 175/323 |

*Primary Examiner*—Dennis L. Taylor

*Attorney, Agent, or Firm*—Watson, Cole, Grindle & Watson

[57] ABSTRACT

A device for forming cast-in-situ piles in civil engineering work includes an auger which consists of a conventional lower part and an upper part comprising a hollow inner element and a removable outer element in the form of an auger having a longitudinal discontinuity which enables it to be fitted over the hollow inner element. The hollow inner element may extend, fixedly, as an elongation of the lower part of the auger or be mounted telescopically in the latter.

4 Claims, 4 Drawing Sheets

8
8
L
ℓ2
1
ℓ1
1
6
16
17

DEVICE FOR MAKING CAST-IN-SITU PILES USING A CONTINUOUS HOLLOW AUGER

BACKGROUND OF THE INVENTION

Making bored and cast-in-situ piles using a hollow continuous auger is a method which has been known and exploited for many decades.

In brief, it consists in penetrating the ground in which it is desired to construct a pile with a continuous auger, the shaft of which is a hollow continuous cylinder, and then, during the inverse (extracting) movement of the continuous auger, in discharging concrete into the bored hole through the conduit formed by the shaft of the auger so as to gradually fill the space which the withdrawal of the auger tends to create.

In order to do this, the continuous auger is generally driven in a combined rotational-translational movement via a rotating engine which is itself capable of being displaced parallel to the axis of the pile which is being formed along a slideway mounted on a stand forming the general framework of the pile machine.

In a first stage (boring stage), the descending rotational/translational movement of the boring engine is generally maintained at substantially less than the value corresponding to the direct screwing in of the auger, with the pitch of the latter being taken into consideration, thus causing the earth along the enveloping surface of the auger to be cut away and the material loading the turns to circulate and rise.

In the second stage of forming the pile, once the specified depth has been reached, the continuous auger is extracted without rotation by a lifting translational movement of the boring head, with pressurized concrete being discharged simultaneously by means of a pump so as to gradually concrete the bored hole as the auger is withdrawn. Perfect and continuous filling can thus be ensured below the moveable plug formed by the turns of the auger themselves, loaded with excavated material The concrete is conveyed into the channel formed by the hollow shaft of the auger through an injection head mounted, via a rotating fitting, either directly on the hollow spindle traversing the boring engine or, in the case of a solid spindle, laterally below the nose of the engine, at the head of the boring line.

The fundamental condition for correctly forming a pile by the hollow-auger method is that the concreting, and consequently the main channel formed by the hollow shaft of the continuous auger, must be maintained continuously.

It is therefore impossible to envisage forming a pile, according to the method described, by successively adding and removing auger elements in order to obtain the overall length of the structure, as is normally the case for making a conventional borehole by adding or removing elements of drilling rod.

This fundamental constraint therefore requires the use of a continuous auger for a length which is at least equal to that of the pile to be formed, employed as a one-piece element and, consequently, requiring a slideway for guiding the boring engine with a corresponding usable length.

Since this slideway must stand up to torsional forces corresponding to the very considerable driving torque required to drive the continuous auger in rotation (up to 20 rpm with the current machines), it assumes, for deep piles, large dimensions and a heavy weight which, as part of the same development, influence the features of the support machine. Furthermore, on-site movements of a machine of this type equipped with a long slideway often pose difficult problems of stability and safety.

SUMMARY OF THE INVENTION

The object of the present invention is to halt the development towards gigantic proportions for the machinery required to form cast-in-situ piles of a great length and, to this end, provides a device enabling a continuous auger comprising elements which can be joined end to end during operation to be used and enabling any breaking of the continuity of the concreting line to be avoided.

The opportunity results therefrom of forming piles of a great length with a working slideway having a usable length which is substantially shorter than that required with the machinery currently employed, with all the corresponding favourable consequences as regards present savings on investment and efficiency.

More particularly, the present invention concerns a device for forming cast-in-situ piles which comprises a combination of:

a slideway, an engine which can slide along this slideway and is capable of communicating a rotational/translational movement to an auger, an auger driven by the said engine extending parallel to the slideway and having a hollow central shaft open at its lower end, means for conveying concrete to the upper part of the hollow shaft and for discharging it at the lower end of the shaft, characterized in that the slideway has a usable length less than the length of the pile to be formed;

the auger has a lower part with a usable length not more than that of the slideway, formed from a hollow shaft and a screw integral with the hollow shaft, and an upper part formed from a hollow inner element and from at least one removable outer element in the form of an auger having a longitudinal discontinuity which enables it to be fitted laterally over the hollow inner element of the upper part, the hollow inner element of the upper part extending as an elongation of the hollow shaft of the lower part or being mounted telescopically in the hollow shaft of the lower part so as to be capable of being telescoped into a position where it extends as an elongation of the hollow shaft of the lower part;

the engine is slideably mounted on the hollow inner element of the upper part and can be locked on the latter when the hollow inner element of the upper part extends as an elongation of the hollow shaft of the lower part, or is mounted fixedly on the hollow inner element of the upper part and can be locked either on the lower part of the auger or on the shaft of the upper auger section when the hollow inner element of the upper part is mounted telescopically in the hollow shaft of the lower part.

The inventive step on which the invention is based lies in the separation of the two functions ensured by the hollow continuous auger, in other words:

the boring, partial extraction of the materials, support for the bore walls and movable plug during concreting function ensured by the screw of the continuous auger, the channel for supplying concrete during concreting function ensured by the hollow shaft of the continuous auger.

This enables the possibility of driving the auger by the translational/rotational engine at intermediate points on the main boring line without needing to cut the latter.

The invention will be readily understood from the following description made with reference to the attached drawings.

DETAILED DESCRIPTION OF THE PREFERRED EMBODIMENT

In order to facilitate the explanation, the description of the device of the invention is made in the particular instance where a pile of length L is formed with a slideway of usable length L/2. The same principle would enable the same pile to be formed with a slideway of useful length L/3, L/4, etc.

Figures 11, 12, 13, 14, 15, 16, 17, 18, 19:
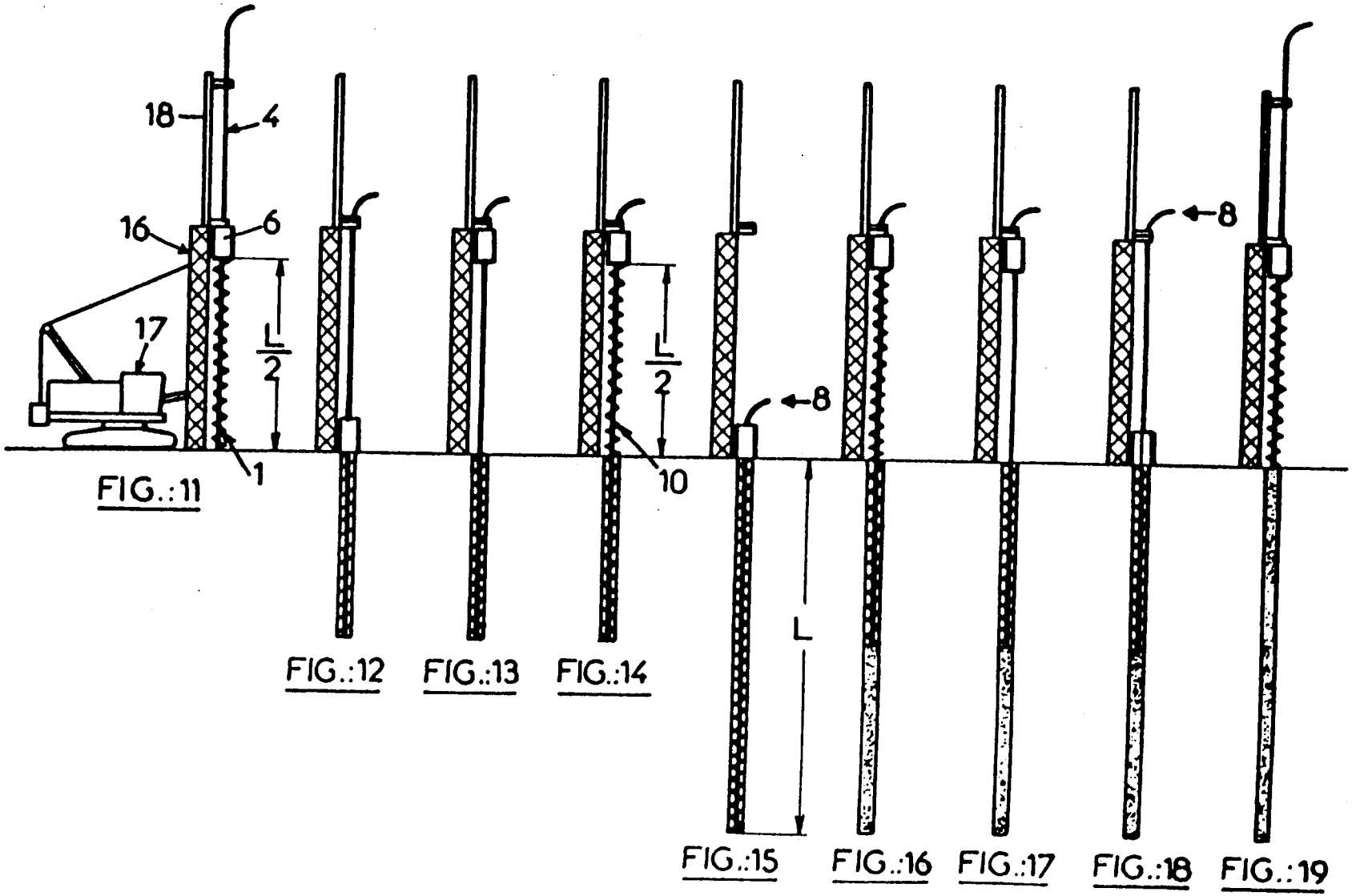
FIGS. 11 to 19 are diagrammatic views illustrating the various stages for forming a cast-in-situ pile using the device in FIGS. 1 to 7.
Figure 25:
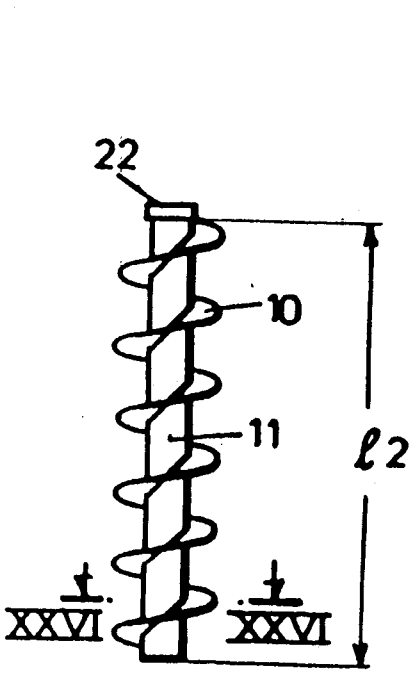
FIGS. 20 to 26 are views similar to those in FIGS. 1 to 7 but illustrating an alternative embodiment of the device of the invention.
Figure 26:
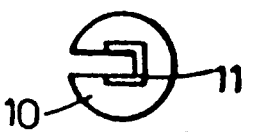
Figure 23:
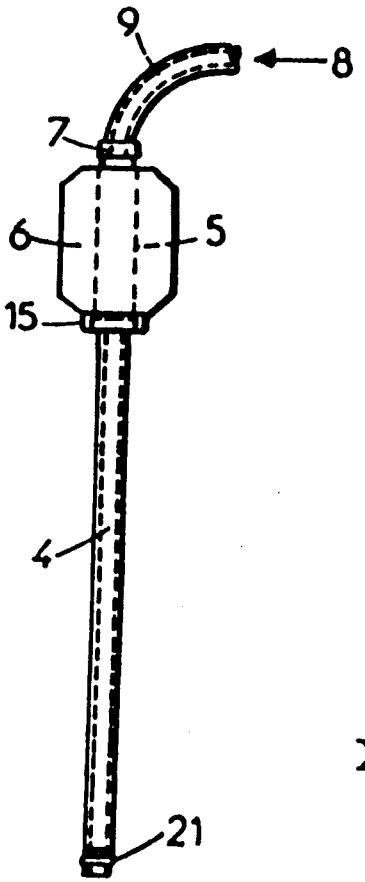
Figure 24:
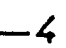
Figure 21:
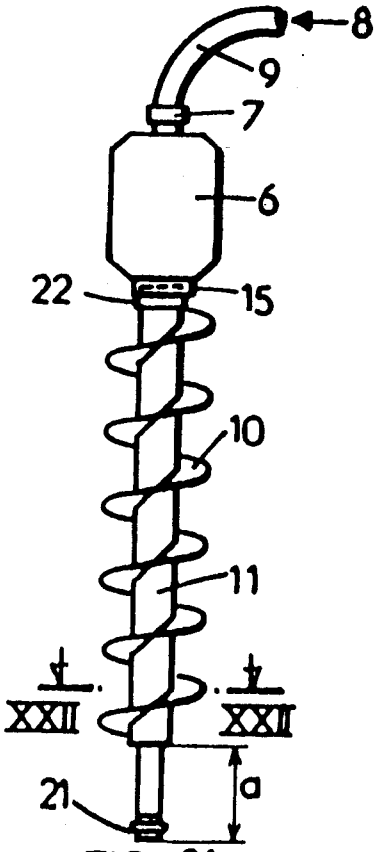
Figure 22:
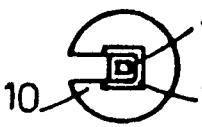
Figure 20:
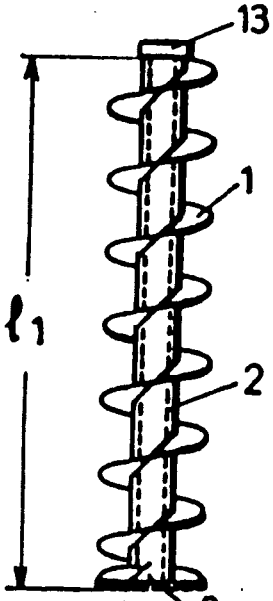
Figures 27, 28, 29, 30, 31, 32, 33, 34, 35:
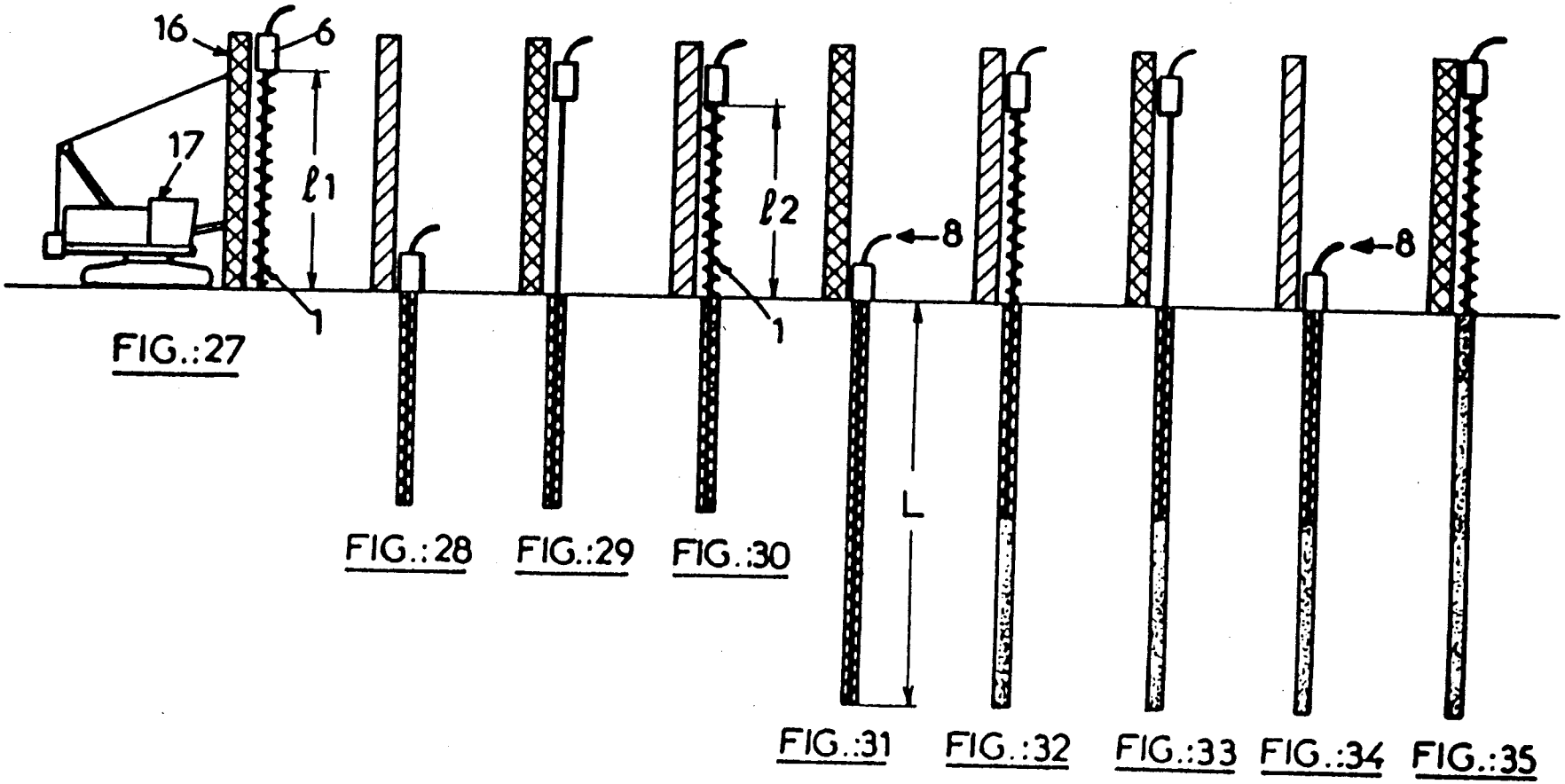
FIGS. 27 to 35 are diagrammatic views illustrating the various stages of forming a cast-in-situ pile using this alternative.

As can be seen in FIG. 11, the device comprises a boring line which can be driven in rotation by a hollow-shaft engine 6 which can be slid on a slideway 16 mounted on a vehicle 17 in order to communicate a translational movement to the boring line.

The boring line comprises two distinct parts:

a lower part (FIG. 1) of length L/2 formed from a section of a conventional hollow continuous auger 1, the hollow shaft 2 of which, circular or polygonal in section, is in communication with the outside at its lower end 3 enabling concrete to be discharged into the bored hole at the appropriate moment;

an upper part (FIGS. 2 and 3) of usable length L/2 formed from an inner element and an outer element which can be fitted over each other enabling the continuity of the auger to be restored behind the lower section, once the latter has been driven into the earth.

The hollow inner element (FIGS. 4 and 5), or driving element, is a hollow tube 4 with a polygonal (for example square) outer section which can be made integral with the upper part of the hollow shaft 2 Of the lower auger section. To this end, the lower part of the inner element 4 and the upper part of the hollow shaft 2 may, as shown, have a tapered mounting profile.

This inner element has a length L/2 increased by the length required to traverse the hollow shaft 5 of the rotational/translational engine 6 and for the rotating fitting 7 for the concrete supply 8 to be mounted at its upper end.

By means of this mounting, provided so as not to be separated for the entire duration of a specific piece of work, continuity of the concrete-supply channel 9 is achieved, a fundamental condition for forming a cast pile using a hollow auger.

The outer element (FIGS. 6 and 7) is a section of hollow auger 10 with a length L/2 the hollow shaft 11 of which has an inner cross-section which closely matches the polygonal outer cross-section of the hollow inner driving element and the screw of which is identical to that of the lower auger section. The shaft 11 and the screw of the upper hollow auger section 10 are interrupted vertically over a width which just enables the passage of the hollow inner driving element 4.

By means of the cooperation of the two inner and outer elements, it is thus possible, by simple engagement, to form a complete section of hollow auger of length L/2 and consequently to reconstruct, with the lower section of length L/2, the complete continuous hollow auger necessary for forming the cast pile of length L. Female collars 13 and 14 situated respectively at the head of the shaft of the lower section and at the lower part of the boring engine, or any other equivalent system respectively, enable the outer element of the upper auger section to be immobilized as an elongation of the lower auger section.

Figures 1, 2, 3, 4, 5, 6, 7, 8, 9, 10:
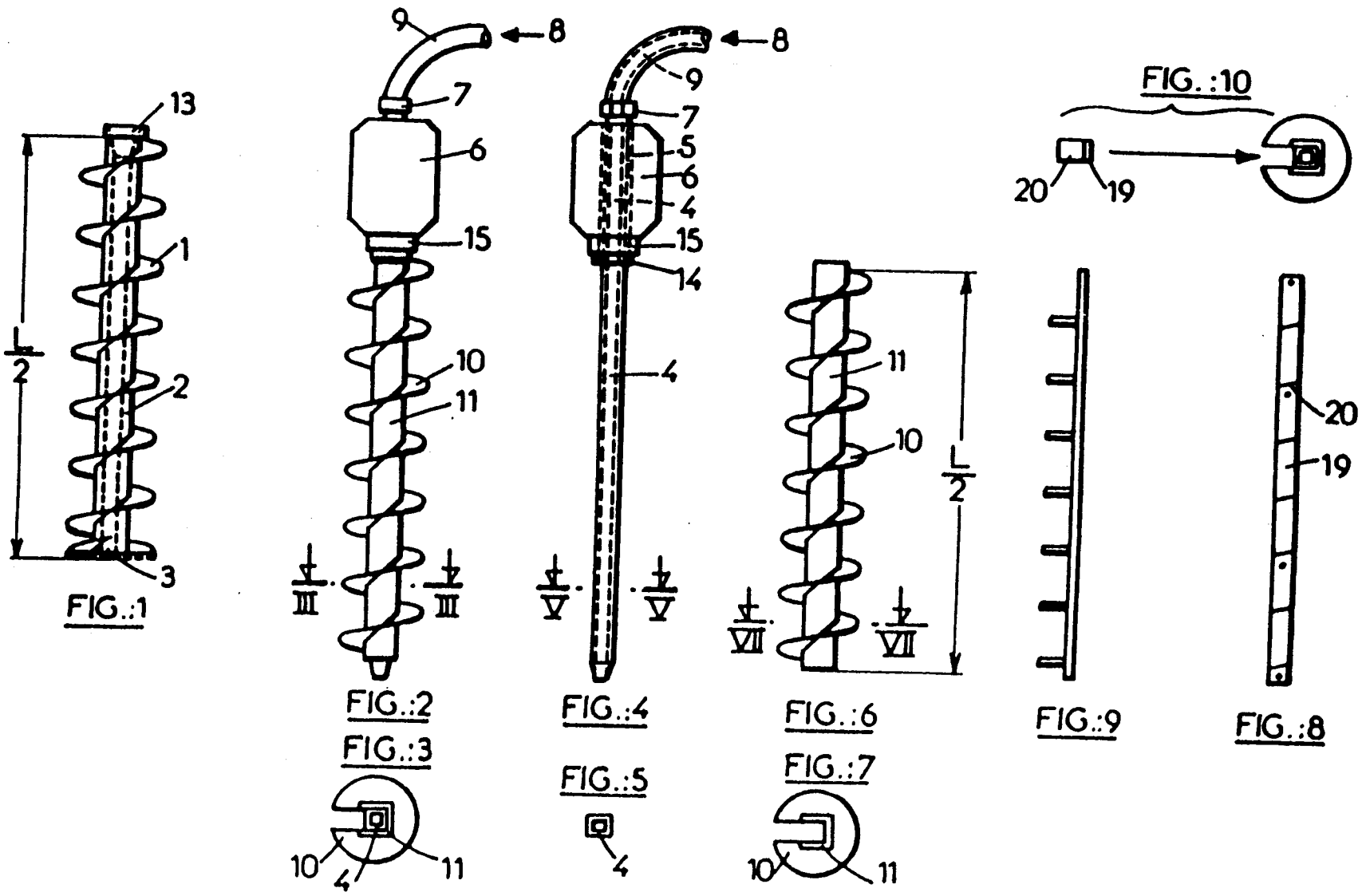
FIG. 1 is a diagrammatic side view of the lower part of the auger of the device of the invention.
FIGS. 2 and 3 are respectively a side view and cross-sectional diagrammatic view along the line III—III of FIG. 2 of the upper part of the auger of the device of the invention, the removable element being fitted onto the hollow inner element of the upper part.
FIGS. 4 and 5 are respectively a side view and cross-sectional diagrammatic view along the line V—V, of FIG. 4 of the hollow inner element of the upper part of the auger of the invention.
FIGS. 6 and 7 are respectively a side view and a cross-sectional diagrammatic view along the line VII—VII of FIG. 6 of the removable element which can be fitted on the upper part of the auger of the invention.
FIGS. 8, and 9 are respectively a front and side diagrammatic views of a complementary element which can be secured to the removable element of FIGS. 6 and 7.
FIG. 10 is a cross-sectional diagrammatic view showing how the complementary element can be assembled with the removable element, the complementary element being seen at the level of line IX—IX of FIG. 9.

The device which has just been described has a discontinuity perpendicular to each turn of the upper continuous auger section so as to allow the passage of the hollow inner driving element. This solution for the continuity has, in geometric terms, only a relatively small size (8% of the arc for an auger of 60 cm in diameter and a square inner element with a side length of 15 cm) and, as a rule, has no influence on the operations of boring and concreting the pile. The continuity of the screw of the auger may, however, if desired, be restored, for example by the rapid fastening onto the free face of the hollow inner driving element 4 of an element 19 provided with turn sections 20 (FIGS. 8 and 9), exactly reestablishing the general geometry of the auger, as FIG. 10 illustrates Any other equivalent means could be used instead of the element 19 (articulated or non-articulated movable flaps, etc . . . ).

The procedure for forming a cast pile of length L with the device of the invention is as follows:

* At the start of operations, the boring engine is at the top of the slideway of usable length L/2 (FIG. 11). The boring line consists, below the boring engine 6, of the lower continuous auger section 1 and, through and above the boring engine, of the hollow inner driving element 4.

The slideway 16 of the pile machine 17 is given dimensions such that it can stand up to the maximum torque of the engine. It is extended over a certain length by an auxiliary jib 18, whose role is to limit the oscillations of the hollow inner driving element during the boring and concreting operations.

The nose of the boring engine is equipped with a hydraulic or mechanical clamping chuck 15 which enables, by locking onto the hollow inner driving element, a tensile, holding or compressive force to be exerted on the boring line.

* Once the lower auger section has been introduced by rotation into the earth (FIG. 12), the chuck of the engine is unlocked and the boring engine raised again to the head of the slideway (FIG. 13).

* The upper auger section 10 is then fitted over the inner driving element with which it is thus made integral by rotation and locked in position via lower 13 and upper 14 collars, thus preventing any lateral disengagement. The chuck of the boring engine is locked on the inner driving element, thus preventing any axial displacement of the upper auger section (FIG. 14).

* Once the screw of the auger has been lengthened in this way and the mechanical continuity of the boring line has been ensured, boring of the pile is concluded (FIG. 15).

The following inverse operations enable the concreting of the pile to be carried out without breaking the concreting channel;

* Raising the boring engine to the head of the slideway, without rotation, coordinated together with the pumping of concrete through the rotating fitting and the concreting channel into the bored hole (FIG. 16).

* Unlocking the chuck of the engine, disengaging and removing the upper auger section (FIG. 17).

* Lowering the boring engine again and locking the chuck in a position at the head of the lower auger section (FIG. 18).

* Raising the boring engine again to the head of the slideway, without rotation, coordinated together with the pumping of concrete into the bored hole (FIG. 19).

The operations of locking and unlocking the chuck of the boring engine on the hollow inner driving element, and the addition and removal of the upper auger section could be entirely automated, thus contributing to the economy of the method.

FIGS. 20 to 26 illustrate a variant of the device of the invention according to which the hollow inner element of the upper part of the tool is mounted telescopically inside the hollow shaft of the lower auger section. In these figures identical references to those in FIGS. 1 to 7 are used to designate similar constituent parts.

The boring line employed thus comprises the following two distinct parts:

a lower part 1, of length $l_1$, identical to that in the embodiment of the device previously described but in which the hollow shaft 2 has a polygonal inner cross-section, an upper part of usable length $l_2$, also formed from two elements 4 and 10 which can be fitted over each other, enabling the continuity of the auger to restored behind the lower section, once the latter has been driven into the earth.

The inner hollow element of the upper part is a hollow tube 4 of polygonal (for example square) outer cross-section matching the shape of the inner cross-section of the hollow shaft 2 of the lower auger section so as to enable it to slide freely inside the latter, while making them coupled when rotating. An annular seal 21 mounted on the hollow inner element enables sealing to be ensured with the shaft of the auger when the concrete is discharged.

This inner element has a length $l_2$ increased by the length a required for the shaft of the lower auger section to encase the hollow inner element, and by the length required for connection with the rotating fitting 7.

The outer element is a hollow auger section 10 and with a length $l_2$ identical to that in the previous embodiment and except that it has, at its top, a collar 22.

The engine 6 is integral with the upper end of the telescopic inner element 4 of the upper part and can be locked onto the head of the lower auger section.

The procedure for forming a cast pile of length $L=l_1+l_2$ with this variant of the device is largely identical to that of the previous embodiment and is illustrated by FIGS. 27 to 35.

At the start of operations, the boring engine is at the top of the slideway 16 of usable length $l_1$. The boring line consists, below the boring engine 6, of the continuous auger section and of the hollow inner driving element engaged inside the shaft of the auger section over the entire height of the latter.

The base of the boring engine is equipped with a hydraulic or mechanical clamping chuck 15 which enables, by locking onto the collar 13 of the shaft of the lower auger section, a tensile, holding or compressive force to be exerted on the boring line.

Once the lower auger section has been introduced by rotation into the earth, the chuck of the engine is unlocked and the boring engine raised again to the head of the slideway, pulling out the hollow inner element by its entire usable length $l_2$ by the sliding of the latter in the shaft of the auger.

The upper auger section is then fitted over the hollow inner element pulled out and locked in position by the collar 13, and the chuck 15 of the boring engine is locked onto a collar 22 provided at the top of the shaft of the upper auger section. Boring of the pile is concluded.

The following inverse operations enable the concreting of the pile to be carried out without cutting the concreting channel:

raising the boring engine to the head of the slideway, without rotation, coordinated together with the discharge of concrete, unlocking the chuck of the engine, disengaging and removing the upper auger section, lowering the boring engine again, causing penetration of the hollow inner driving element by sliding in the shaft of the lower auger section and locking the chuck on the head of the shaft of the auger, raising the boring engine again to the head of the slideway, without rotation, coordinated together with the discharge of the concrete The above variant of the device of the invention makes it possible to do without the presence of the jib 18 as an extension of the boring slideway.

I claim:

1. A device for forming cast-in-situ piles which comprises:

a slideway, an engine which can slide along said slideway and is capable of communicating a rotational/translational movement to an auger, an auger driven by said engine extending parallel to the slideway and having a hollow central shaft which is open at its lower end, means for conveying concrete to the upper part of said hollow shaft and for discharging it at the lower end of the shaft, said slideway having a usable length less than the length of the pile to be formed, said auger having a lower part with a usable length not more than that of the slideway, formed from a hollow shaft and a screw integral with said hollow shaft, and an upper part formed from a hollow inner element having a polygonal cross-section and from at least one removable outer element in the form of an auger having a hollow shaft the inner cross-section of which closely matches the polygonal cross-section of said hollow inner element and a longitudinal discontinuity enabling it to be fitted laterally over the hollow inner element of said upper part, the hollow inner element of said upper part extending as an elongation of the hollow shaft of said lower part, and said engine being slidably mounted on said hollow inner element of said upper part and being lockable on the latter.

2. A device according to claim 1, further comprising a removable additional element positioned in said discontinuity, secured to said hollow inner element of said upper part of said auger and provided with screw section restoring the continuity of the auger screw.

3. A device for forming cast-in-situ piles which comprises:

a slideway, an engine which can slide along said slideway and is capable of communicating a rotational/translational movement to an auger, an auger driven by said engine extending parallel to the slideway and having a hollow central shaft which is open at its lower end, means for conveying concrete to the upper part of said hollow shaft and for discharging it at the lower end of the shaft, said slideway having a usable length less than the length of the pile to be formed, said auger having a lower part with a usable length not more than that of the slideway, formed from a hollow shaft and a screw integral with said hollow shaft, and an upper part formed from a hollow inner element having a polygonal cross-section and from at least one removable outer element in the form of an auger having a hollow shaft the inner cross-section of which closely matches the polygonal cross-section of said hollow inner element and a longitudinal discontinuity enabling it to be fitted laterally over the hollow inner element of said upper part, the hollow inner element of said upper part being mounted telescopically in the hollow shaft of said lower part so as to be capable of being telescoped into a position where it extends as an elongation of the hollow shaft of said lower part, and said engine being mounted fixedly on said hollow inner element of said upper part and being lockable either on the lower part of the auger or on the shaft of the upper auger section.

4. A device according to claim 3, further comprising a removable additional element positioned in said discontinuity, secured to said hollow inner element of said upper part of said auger and provided with screw section restoring the continuity of the auger screw.

* * * * *